United States Patent [19]

Bullard

[11] 4,185,702

[45] Jan. 29, 1980

[54] METHOD AND APPARATUS FOR BOREHOLE PERFORATING

[76] Inventor: Gerald D. Bullard, c/o Goodwell Inc., P. O. Box 195, Upton, Wyo. 82730

[21] Appl. No.: 896,197

[22] Filed: Apr. 13, 1978

[51] Int. Cl.[2] ..... E21B 7/00

[52] U.S. Cl. ..... 175/4.54; 102/21.6

[58] Field of Search ..... 175/4.5, 4.55, 4.59, 175/4.57, 4.54; 102/20, 21, 21.6

[56] References Cited

U.S. PATENT DOCUMENTS

| | | | |
|---|---|---|---|
| 2,809,585 | 10/1957 | Moses | 175/4.6 X |
| 2,946,283 | 7/1960 | Udry | 175/4.59 X |
| 3,216,320 | 11/1965 | Thomas et al. | 175/4.5 X |
| 3,358,780 | 12/1967 | Venghiattis | 175/4.5 |
| 3,620,314 | 11/1971 | Bohn | 175/4.59 |

*Primary Examiner*—James A. Leppink
*Assistant Examiner*—Richard E. Favreau
*Attorney, Agent, or Firm*—Wm. T. Wofford

[57] ABSTRACT

Method and apparatus for perforating an earth formation from a well bore wherein each perforator unit of a perforator gun utilizes the combination of a shaped charge and a bullet and the perforator unit is adapted to fire the shaped charge responsive to detonation of detonating cord and the bullet is fired responsive to the firing of the shaped charge.

3 Claims, 6 Drawing Figures

METHOD AND APPARATUS FOR BOREHOLE PERFORATING

FIELD OF THE INVENTION

The invention relates to method and apparatus for borehole perforating and more particularly to such perforating wherein the apparatus utilizes a bullet and shaped charge combination.

BACKGROUND OF THE INVENTION

In a typical case, the borehole for an oil well prior to completion of the well has casing set therein and extending through the depth zone in which the oil bearing formation lies, with cement in place between the casing and the formation. To complete the well, some means is provided to perforate the casing and cement and, to some extent, the formation, so as to permit flow of oil from the formation into the casing (or tubing) in which it is carried to the surface.

The perforating is accomplished by apparatus including one or more perforating guns which are suspended in the casing (or tubing) in the zone to be perforated. Each gun carries a plurality of perforator units, which conventionally are either bullets or shaped charges.

It is desirable that the perforator unit should penetrate as far as possible into the formation and create the best possible environment for the flow of oil from the formation into the casing (or tubing).

In order to enhance the effectiveness of perforations, it has been proposed in the prior art to utilize in each perforator unit the combination of a shaped charge and a bullet. However, prior art attempts to effectively utilize such combination have not proved successful. In U.S. Pat. No. 2,946,283, which exemplifies such prior art attempts, the bullet charge is first ignited, so that the bullet moves forward and strikes a detonator cap which then ignites the shaped charge. This arrangement does not function satisfactorily since the bullet has a strong tendency to interfere with the action of the shaped charge and vice versa. The result is a negative effect instead an enhancement.

The object of this invention is to provide a method and apparatus wherein each perforator unit of a perforator gun utilizes the combination of a shaped charge and a bullet in such manner as to significantly enhance the effectiveness of resulting perforations.

For a further understanding of the invention and further objects, features, and advantages thereof, reference may now be had to the following description taken in conjunction with the accompanying drawing.

DESCRIPTION OF PREFERRED EMBODIMENTS

Figure 1:
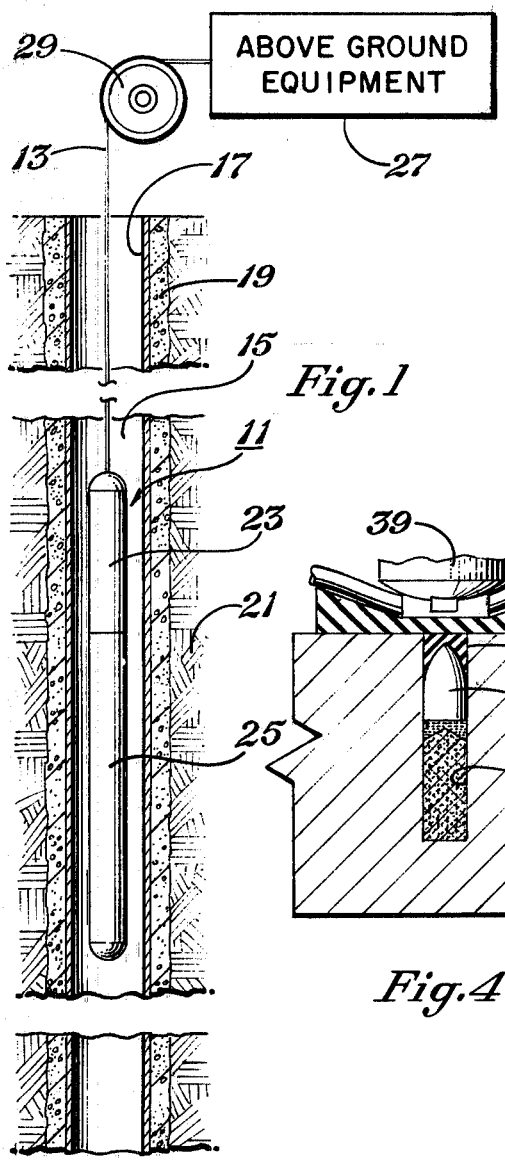
FIG. 1 is a schematic view showing a perforator tool embodying the present invention suspended in a well bore at the depth of a formation to be perforated.

In FIG. 1 there is shown a perforator tool 11 suspended by a wire line 13 in a wall bore 15 at the level of an earth formation to be perforated. Conventional casing 17 and cement 19 are interposed between the well bore 15 and the earth formation 21. The perforator tool 11 conventionally includes an instrumentation portion 23 and a perforator gun 25. The instrumentation portion conventionally includes casing collar locator and firing circuit apparatus (not shown). The perforator tool 11 is controlled by conventional above ground equipment which is indicated by a block 27. Conventional cable drum hoist apparatus is indicated at 29.

Figure 2:
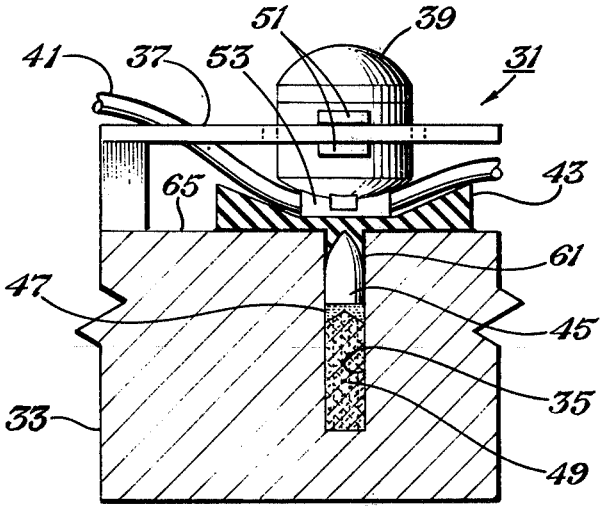
FIG. 2 is a schematic fragmentary elevational view, partly in longitudinal section, showing a single perforator unit of a perforator gun in accordance with a preferred embodiment of the present invention.
Figure 3:
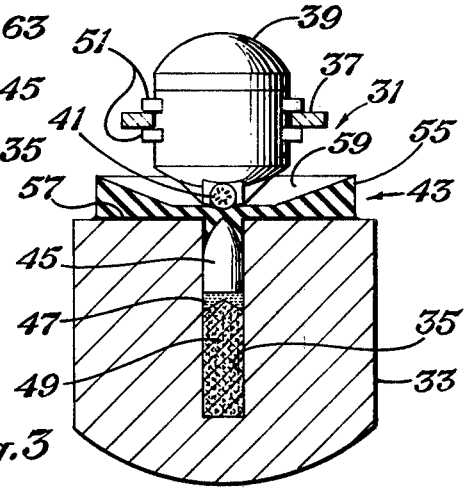
FIG. 3 is a schematic fragmentary elevational view, partly in transverse section, showing the single perforator unit of FIG. 2.

The perforator gun 25 is made to incorporate a plurality of perforator units 31 of the type shown by FIGS. 2 and 3. The perforator gun 25 has a body 33 having a bullet receiving bore 35 at each perforator unit location. Mounted on the perforator gun body 33 is a shaped charge carrier means 37.

Each perforator unit 31 includes a shaped charge 39, detonating cord 41, such as that commonly known to the trade as "Primacord", sealing means 43, a bullet 45, a gas check 47, and a bullet powder load 49.

The shaped charge 39 may be of a conventional type commonly used with open charge carrier type perforating guns. In the embodiment shown, the shaped charge has oppositely disposed mounting protrusions 51 which form slots that receive shaped charge carrier means structure 37 when the shaped charge 39 is placed in a receiving opening in the carrier and rotated. The shaped charge 39 is provided the usual detonating cord receiving slot 53 at its base end, and the detonating cord prevents the shaped charge 39 from being rotated to a release position. When the shaped charge 39 is mounted and retained on the carrier means 37, it is disposed so as to face outwardly in coaxial alignment with the bullet receiving bore 35 and adjacent the outer end of the bore.

The bullet powder load 49 is preferably black powder compressed to pellet form. The powder load 49 is placed in the bore 35, followed by the gas check 47 and the bullet 45. The bullet 45 and the gas check 47 may be of conventional design as normally used with bullet type perforating guns.

Seal means 43 is provided, effective to prevent entry of fluid into the bore 35 prior to the firing of the perforator unit 31. Entry of fluid would tend to cause malfunction of the powder load 49. In the embodiment shown in FIGS. 2 and 3, the seal means 43 is a 1-piece molded rubber pad 55, together with a suitable adhesive material 57. The pad 55 may be rectangular in shape and typically about 2½ inches long by 2 inches wide by ½ inch in thickness, and having generally planar inner and outer surfaces. A detonating cord receiving groove 59 is molded in the pad outer surface and a cylindrical protrusion 61 is molded to extend from the pad inner surface. The cylindrical protrusion 61 mates with and extends a short distance into the bore 35, and is shaped at its end face to sealingly conform with the shape of the tapered end portion of the bullet 45. The shaped charge 39 tends to hold the pad protrusion 61 against outward movement, while the powder load length is made such as to cause the bullet 45 to slightly compress the end face of the pad protrusion 61 so as to encourage the protrusion to form a seal with the bore 35. To further insure sealing, particularly when the well fluid pressures acting on the pad are low, adhesive material 57 is interposed between the pad lower surface and the gun body face 65 and between the cylindrical protrusion 61 and the bore 35.

Figure 4:
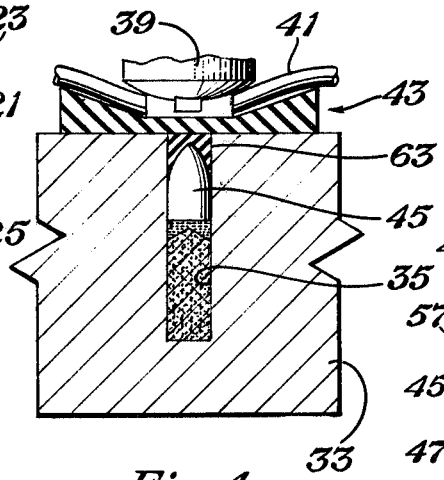
FIG. 4 is a schematic fragmentary elevational view, partly in longitudinal section, showing a modified seal arrangement for the single perforator unit of FIGS. 2 and 3.

In the embodiment shown by FIG. 4, the cylindrical protrusion is a separate piece of rubber 63 which has been molded to have a diameter larger than that of the bore 35, so that it is radially compressed when installed in the bore. With this embodiment, the adhesive material 57 may not be needed. In fact, the sealing means 43 can take any form that will be effective to prevent entry of fluid into the bore 35 prior to the firing of a perforator unit 31.

In a typical application, the shaped charge 39 may be 1 11/16 inches in diameter, with the space between the shaped charge lower extremity (lower surface of detonating cord receiving slot 53) and the outer extremity of the bore 35 being about ⅛ inch, with the bore having a diameter of about ⅜ inch and a depth of about 2 inches, and with the powder load 49 being about 1 3/16 inches long. The material for the pad 55 and the cylindrical protrusion 63 may be 80 durometer Hycar rubber, and the adhesive material 57 may be that sold under the name Permatex.

In operation, the perforator tool 11 is run into the well 15 on a wire line 13 to the depth of the earth formation to be perforated and the operator manipulates the firing circuit controls at the above-ground equipment 27, all in a conventional manner. The perforator units 31 of the gun 25 may be fired either selectively or in a predetermined sequence, as determined by the type of firing control circuits utilized.

In the case of the perforator units of the present invention, a respective perforator unit 31 is fired by the detonation of the detonating cord 41 that is associated with that unit. Detonation of the detonating cord 41 actually fires the shaped charge 39 and the bullet powder load is ignited responsive to the firing of the shaped charge 39. While the precise phenomenon of the powder load ignition is not fully understood, the powder load ignition is believed to result from a combination of impact and pressure forces generated by the firing of the shaped charge 39 and which act on the bullet 45, which then causes impact and pressure forces to be applied to the powder load 49 with resulting ignition.

Figure 5:
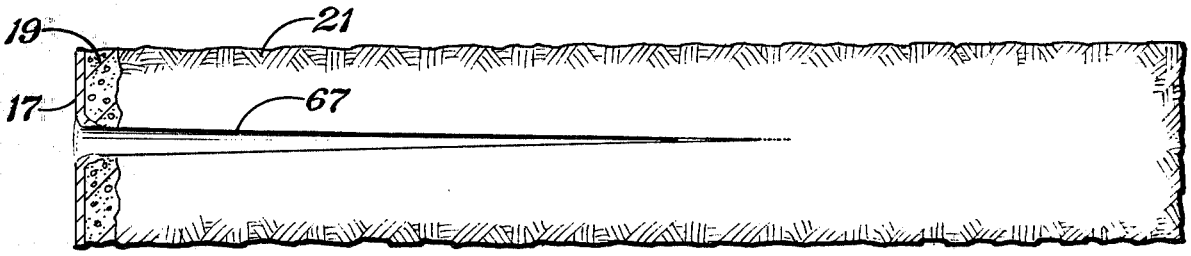
FIG. 5 is a schematic fragmentary section view showing in idealized form a perforation made by a perforator unit utilizing a shaped charge, alone.
Figure 6:
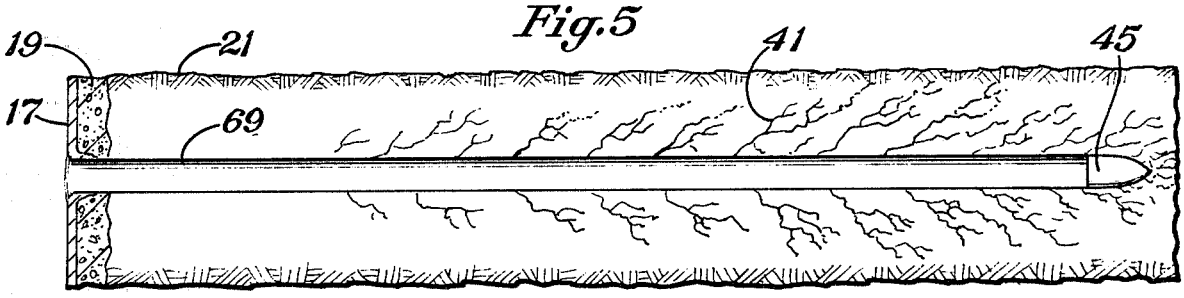
FIG. 6 is a schematic fragmentary section view showing in idealized form a perforation made by a perforator unit utilizing the method and apparatus of the present invention.

It is has been found in practice that the utilization of the perforator units of the present invention results in a significant enhancement of the effectiveness of resulting perforations. FIGS. 5 and 6, while shown in idealized form, are intended to illustrate such enhanced effectiveness. FIG. 5 shows a perforation 67 as made by a shaped charge alone; while FIG. 6 shows a perforation 69 as made by a perforator unit 31 of the present invention. It will be apparent that the perforation 69 of FIG. 6 is of a generally constant diameter; has a considerably greater length; and has formation fractures 71 extending outwardly therefrom. It is further apparent that the perforation 69 of FIG. 6 represents a significant enhancement of the environment for the flow of oil from the formation into the casing and/or tubing.

In one aspect, the present invention involves a method of perforating an earth formation from a well bore, comprising the steps of:

a. making up a perforator gun having a gun body, a bullet receiving bore in the gun body, shaped charge carrier means mounted on the gun body, and a perforator unit mounted on the carrier means, with the perforating unit including:

i. a shaped charge disposed on said carrier means so as to face outwardly in co-axial alignment with and adjacent the outer end of said bore;

ii. a bullet disposed in said bore with a powder load behind the bullet;

iii. seal means effective to prevent entry of fluid into said bore prior to the firing of said unit;

iv. detonating cord disposed in firing relation to said shaped charge and being the sole means to initiate the firing of said unit;

b. suspending said gun in said well bore at the depth of the earth formation to be perforated;

c. detonating said detonating cord to initiate the firing of said unit.

In another aspect, a method of perforating an earth formation from a well bore in accordance with the present invention may comprise the steps of:

a. making up a perforator tool including a gun of a type having a plurality of perforating units with each perforating unit comprising the combination of a shaped charge and a bullet with its associated powder load, with the bullet disposed behind, adjacent to, and axially aligned with the shaped charge;

b. suspending the perforator tool in the well bore at the depth of the earth formation to be perforated;

c. firing the shaped charge of a respective perforating unit, and utilizing the action of the fired shaped charge to act on the bullet to cause ignition of the bullet powder load.

The foregoing disclosure and the showings made in the drawing are merely illustrative of the principles of this invention and are not to be interpreted in a limiting sense.

What is claimed is:

1. A perforator gun comprising:

a. a gun body having a bullet receiving bore;

b. shaped charge carrier means mounted on said gun body;

c. a perforator unit including:

i. a shaped charge disposed on said carrier means so as to face outwardly in co-axial alignment with and adjacent the outer end of said bore;

ii. a bullet disposed in said bore with a powder load behind the bullet;

iii. seal means effective to prevent entry of fluid into said bore prior to the firing of said unit;

iv. detonating cord disposed in firing relation to said shaped charge and being the sole means to initiate the firing of said unit;

said perforator unit being thus adapted to fire said shaped charge responsive to detonation of said detonating cord and to fire said bullet responsive to the firing of said shaped charge.

2. The method of perforating an earth formation from a well bore, comprising the steps of:

a. making up a perforator gun having a gun body, a bullet receiving bore in the gun body, shaped charge carrier means mounted on the gun body, and a perforator unit, with said perforator unit including:

i. a shaped charge disposed on said carrier means so as to face outwardly in co-axial alignment with and adjacent the outer end of said bore;

ii. a bullet disposed in said bore with a powder load behind the bullet;

iii. seal means effective to prevent entry of fluid into said bore prior to the firing of said unit;

iv. detonating cord disposed in firing relation to said shaped charge and being the sole means to initiate the firing of said unit;

v. said perforator unit being thus adapted to fire said shaped charge responsive to detonation of said detonating cord and to fire said bullet responsive to the firing of said shaped charge.

b. suspending said gun in said well bore at the depth of the earth formation to be perforated;

c. detonating said detonating cord to initiate the firing of said unit.

3. The method of perforating an earth formation from a well bore, comprising the steps of:

a. making up a perforator tool including a gun of a type having a plurality of perforator units with each perforator unit comprising the combination of a shaped charge, a bullet receiving bore, and a bullet with its associated powder load, with the bullet disposed in said bullet receiving bore behind, adjacent to, and axially aligned with the shaped charge;

b. suspending the perforator tool in the well bore at the depth of the earth formation to be perforated;

c. firing the shaped charge of a respective perforator unit, and utilizing the action of the fired shaped charge to act on the bullet to cause ignition of the bullet powder load.

* * * * *